US008919583B2

(12) United States Patent
Brasher

(10) Patent No.: US 8,919,583 B2
(45) Date of Patent: Dec. 30, 2014

(54) ACCESSORY MERCHANDISER

(71) Applicant: Milwaukee Electric Tool Corporation, Brookfield, WI (US)

(72) Inventor: Timothy G. Brasher, Wauwatosa, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 14/035,256

(22) Filed: Sep. 24, 2013

(65) Prior Publication Data

US 2014/0053442 A1 Feb. 27, 2014

Related U.S. Application Data

(63) Continuation of application No. 12/365,587, filed on Feb. 4, 2009, now Pat. No. 8,540,088.

(60) Provisional application No. 61/025,904, filed on Feb. 4, 2008.

(51) Int. Cl.

| | |
|---|---|
| ***A47F 5/00*** | (2006.01) |
| ***A47F 5/08*** | (2006.01) |
| ***A47F 5/10*** | (2006.01) |
| ***A47F 5/01*** | (2006.01) |
| ***G09F 7/00*** | (2006.01) |

(52) U.S. Cl.

CPC ..... *A47F 5/083* (2013.01); *A47F 5/0823* (2013.01); *A47F 5/0876* (2013.01); *A47F 5/0869* (2013.01); *A47F 5/103* (2013.01); *A47F 5/01* (2013.01); *G09F 7/00* (2013.01)

USPC .... 211/106; 211/57.1; 211/59.1; 211/106.01; 211/181.1

(58) Field of Classification Search

CPC ..... A47F 5/083; A47F 5/01; A47F 5/0815; A47F 5/08; A47F 5/13; A47F 7/148; A47F 5/0876; A47F 5/0823; A47F 5/0807; A47F 5/0892; A47F 5/0896; A47F 5/0006; A47F 5/00; A47F 5/0068; A47B 55/02; A47B 96/067; A47B 96/06; A47B 96/1466; A47B 96/1475; A47B 96/1408; A47B 55/00; A47G 25/06; A47G 25/746; A47G 1/20; A47G 1/1686; B25H 3/04; G01B 5/004; G01B 5/14; G01B 5/02; G01B 5/143; G01B 3/30; G09F 7/00

USPC ..... 211/106, 106.01, 57.1, 59.1, 4, 54.1, 211/183, 86.01, 94.01, 181.1, 70.6, 193, 211/90.01–90.04; 248/220.41, 220.42, 248/220.43, 215, 301, 227.1, 322, 340, 307, 248/304; 33/613, 1 R

See application file for complete search history.

(56) References Cited

U.S. PATENT DOCUMENTS

| | | | |
|---|---|---|---|
| 2,058,217 | A | 10/1939 | Dixon |
| 2,549,391 | A | 4/1951 | Secord |

(Continued)

OTHER PUBLICATIONS

Photo of Lenox Merchandise Display, available at least as early as Oct. 15, 2007.

(Continued)

*Primary Examiner* — Jennifer E Novosad

(74) *Attorney, Agent, or Firm* — Michael Best & Friedrich LLP

(57) ABSTRACT

An accessory merchandiser for displaying products. The accessory merchandiser includes a modular unit including a plurality of first members and a plurality of second members, wherein the first and second members form a grid structure, a plurality of indicator marks formed on each second member, and a plurality of coupling members configured to removably couple the modular unit to a fixture. The plurality of indicator marks form a marking grid.

20 Claims, 11 Drawing Sheets

(56) References Cited

U.S. PATENT DOCUMENTS

| | | | |
|---|---|---|---|
| 2,589,564 | A | 3/1952 | Moore |
| 2,680,522 | A | 6/1954 | Temple |
| 2,842,264 | A | 7/1958 | Larson |
| 3,279,620 | A | 10/1966 | Nesbitt |
| 3,486,632 | A | 12/1969 | Balch |
| 3,598,248 | A | 8/1971 | Black |
| 4,226,190 | A | 10/1980 | Ashton |
| 4,476,986 | A | 10/1984 | Robinson |
| 4,583,648 | A | 4/1986 | Buffington et al. |
| 4,591,057 | A | 5/1986 | Garfinkle |
| 4,702,380 | A | 10/1987 | Herman |
| 4,768,660 | A | 9/1988 | Handler et al. |
| 4,884,702 | A | 12/1989 | Rekow |
| 5,305,898 | A | 4/1994 | Merl |
| 5,509,541 | A | 4/1996 | Merl |
| 5,526,941 | A | 6/1996 | Ford |
| 5,573,124 | A | 11/1996 | Frost |
| 5,769,248 | A | 6/1998 | Johnson |
| 5,871,115 | A | 2/1999 | Kohn |
| 5,927,517 | A | 7/1999 | Lipman et al. |
| 6,050,426 | A | 4/2000 | Leurdijk |
| 6,161,708 | A | 12/2000 | Myler |
| 6,299,001 | B1 | 10/2001 | Frolov et al. |
| 6,364,137 | B1 | 4/2002 | Glauth et al. |
| 6,473,984 | B1 | 11/2002 | Splain et al. |
| 6,688,478 | B2 | 2/2004 | Miller, Jr. et al. |
| 6,969,036 | B2 | 11/2005 | Magnusson |
| 7,152,748 | B2 | 12/2006 | Vosbikian |
| 7,178,681 | B2 | 2/2007 | Libman |
| 7,198,158 | B2 | 4/2007 | Kao |
| 7,270,242 | B2 | 9/2007 | Liu |
| 7,387,213 | B1 | 6/2008 | Smalley |
| 7,500,574 | B1 | 3/2009 | Miller et al. |
| 7,708,156 | B2 | 5/2010 | Johnson |
| 7,789,248 | B1 | 9/2010 | Salerno et al. |
| 8,540,088 | B2 | 9/2013 | Brasher |
| 2004/0065632 | A1 | 4/2004 | Ondrasik |
| 2005/0263466 | A1 | 12/2005 | Libman |
| 2006/0091092 | A1 | 5/2006 | Vosbikian |
| 2007/0039907 | A1 | 2/2007 | Zandt |
| 2007/0138118 | A1 | 6/2007 | Huber |
| 2007/0241070 | A1 | 10/2007 | Maheu et al. |
| 2008/0099417 | A1 | 5/2008 | Zandt |

OTHER PUBLICATIONS

Photo of Rigid Merchandise Display, available at least as early as Oct. 15, 2007.

Photo of Bosch Merchandise Display, available at least as early as Oct. 15, 2007.

Photo of Milwaukee Electric Tool Company Merchandise Display, available at least as early as Oct. 15, 2007.

ACCESSORY MERCHANDISER

CROSS REFERENCE TO RELATED APPLICATIONS

The present patent application is a continuation of U.S. patent application Ser. No. 12/365,587, titled "ACCESSORY MERCHANDISER" and filed Feb. 4, 2009 by Timothy G. Brasher, now U.S. Pat. No. 8,540,088, which claims priority to U.S. Provisional Patent Application Ser. No. 61/025,904, titled "ACCESSORY MERCHANDISER" and filed on Feb. 4, 2008 by Timothy G. Brasher, the entire contents of both of which are hereby incorporated by reference.

BACKGROUND

The present invention relates to an accessory merchandiser for supporting and displaying merchandise.

Distributors of power tool accessories use merchandiser units or displays to support accessories and products and to permit customers to view accessories or products. Typically, merchandiser units involve a complicated structure. Such a merchandiser unit may include, for example, product specific structure, laterally extending tiers for supporting accessories that increase the depth of the unit, static supports or hooks as well as closely-packed hooks for the products. A complicated structure, such as the example discussed above, creates complex merchandiser unit set-ups and time consuming product position resets for the distributors. In addition to the complicated structure, typical merchandiser units may appear disorganized to the customer, incur high construction costs, provide a weak product brand presence and inefficiently use a space provided for displaying the product.

SUMMARY

In one embodiment, the invention provides an accessory merchandiser for displaying products. The accessory merchandiser includes a modular unit including a plurality of first members and a plurality of second members, wherein the first and second members form a grid structure, a plurality of indicator marks formed on each second member, and a plurality of coupling members configured to removably couple the modular unit to a fixture. The plurality of indicator marks form a marking grid.

In another embodiment, the invention provides an accessory merchandiser for displaying products. The accessory merchandiser includes a grid structure formed by a plurality of first members and second members, a first side and a second side, each of the first side and the second side having a channel, a fixture support configured to releasably couple the grid structure to a fixture, and a plurality of indicator marks formed on each of the plurality of second members.

In yet another embodiment, the invention provides an accessory merchandiser for displaying products. The accessory merchandiser includes a plurality of modular units, each of the plurality of modular units including a plurality of first members and a plurality of second members, such that each modular unit forms a grid structure, and a plurality of indicator marks formed on each second member of the plurality of modular units, such that the plurality of indicator marks form a marking grid. Each of the plurality of modular units includes a coupling member configured to removably couple the modular unit to a fixture, and each of the plurality of modular units is removably couplable to an adjacent modular unit.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
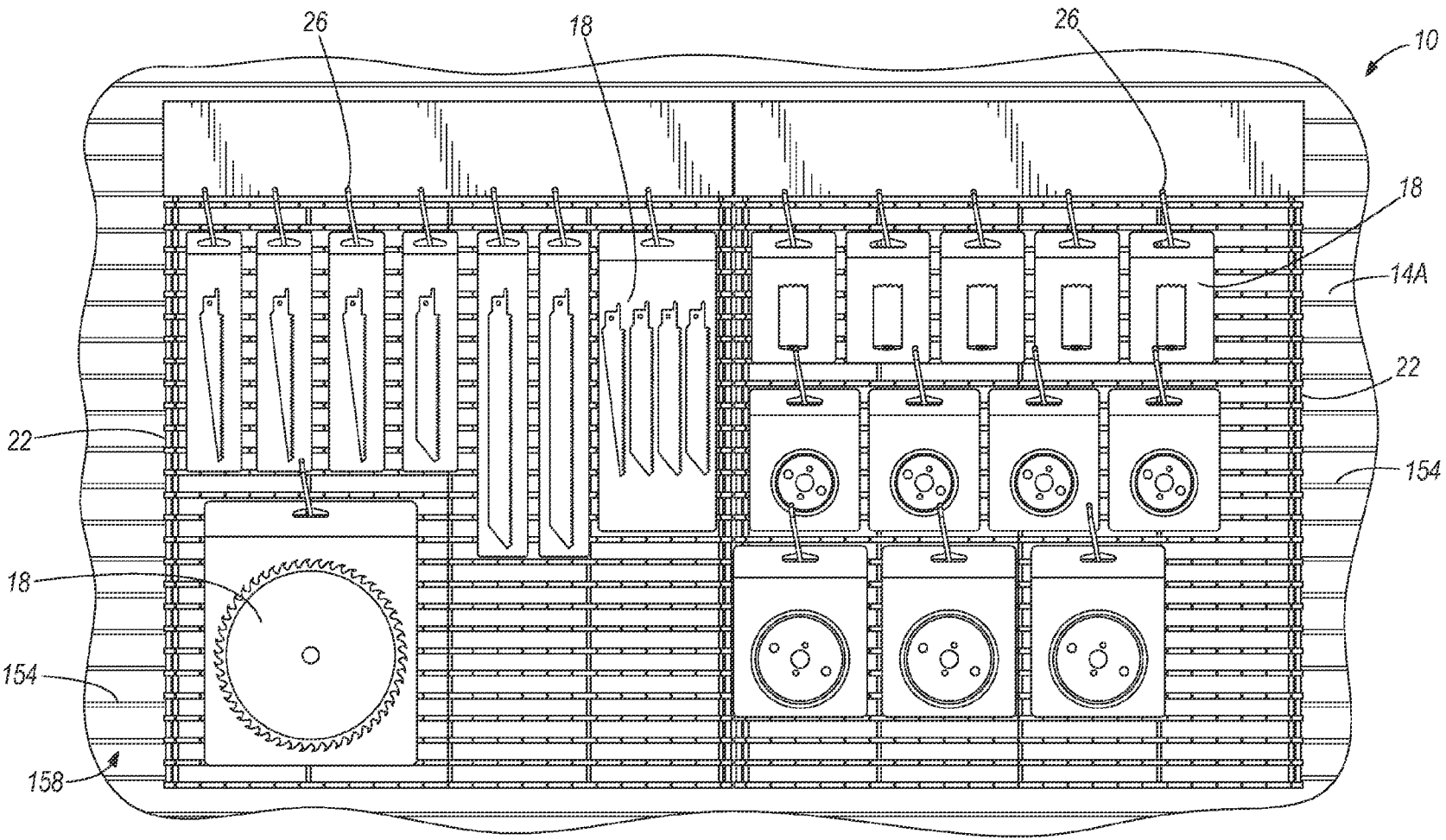
FIG. 1 illustrates a store fixture with an accessory merchandiser according to an embodiment of the invention.

FIG. 1 illustrates an accessory merchandiser 10 according to one embodiment of the invention. The illustrated accessory merchandiser 10 is removably mounted on a slot wall 14A (i.e., a conventional store fixture) for displaying various power tools and power tool accessories 18, such as saw blades, drill bits, auger bits, belts, sander pads, etc. In other constructions, the accessory merchandiser 10 is able to be removably mounted on various store fixtures, such as a pegboard 14B (FIG. 2), a gondola wall, and a drywall. The accessory merchandiser 10 includes a plurality of display modules 22. In other constructions, the accessory merchandiser 10 may be formed of a single display module 22.

Figure 1A:
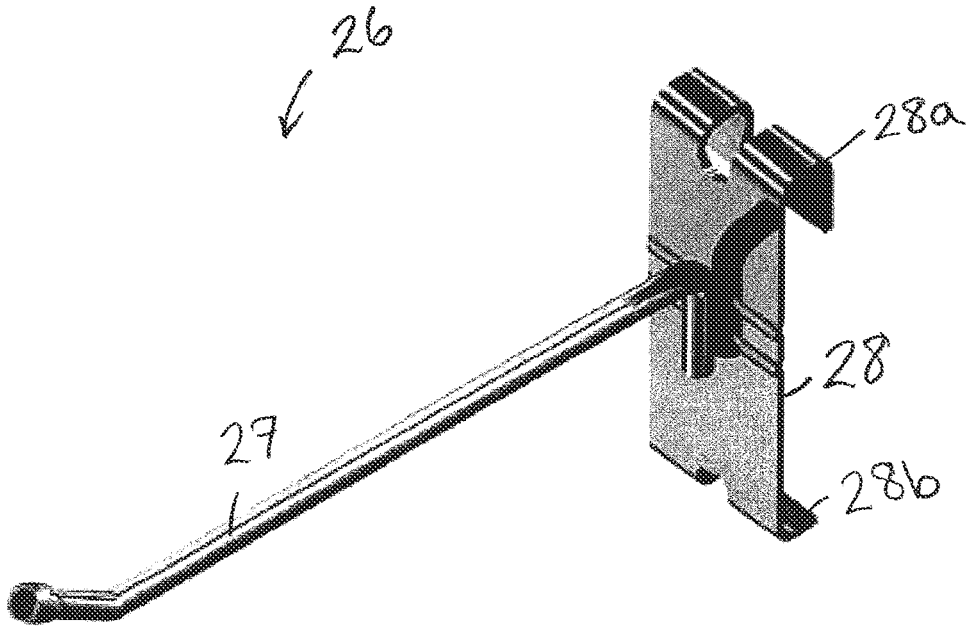
FIG. 1A illustrates a product hook for use with the accessory merchandiser of FIG. 1.

Each display module 22 may include a plurality of product hooks 26 (i.e., product supports) that removably couple to each display module 22. The product hooks 26 are conventional product hooks that support power tools, power tool accessories 18 or other products that a distributor would like a customer to view in a store. As shown in FIG. 1A, the product hook 26 includes a display bar 27 and a fixture hook 28. In the illustrated embodiment, the display bar 27 is adapted to receive a power tool accessory 18, and the fixture hook 28 is C-shaped to couple to the display module 22. The fixture hook includes a top portion 28*a* configured to hang from or otherwise slide onto a horizontal bar 46 of the display module 22 and a bottom portion 28*b* configured to engage an adjacent bar to support the product hook. However, in other embodiments, the product hook 26 may include other shapes or designs to provide for removably coupling to the display module 22 and support of power tool accessories 18 or other products. In still other embodiments, the product supports may support a shelf or other structure configured to support the power tool and/or the power tool accessories.

Figure 2:
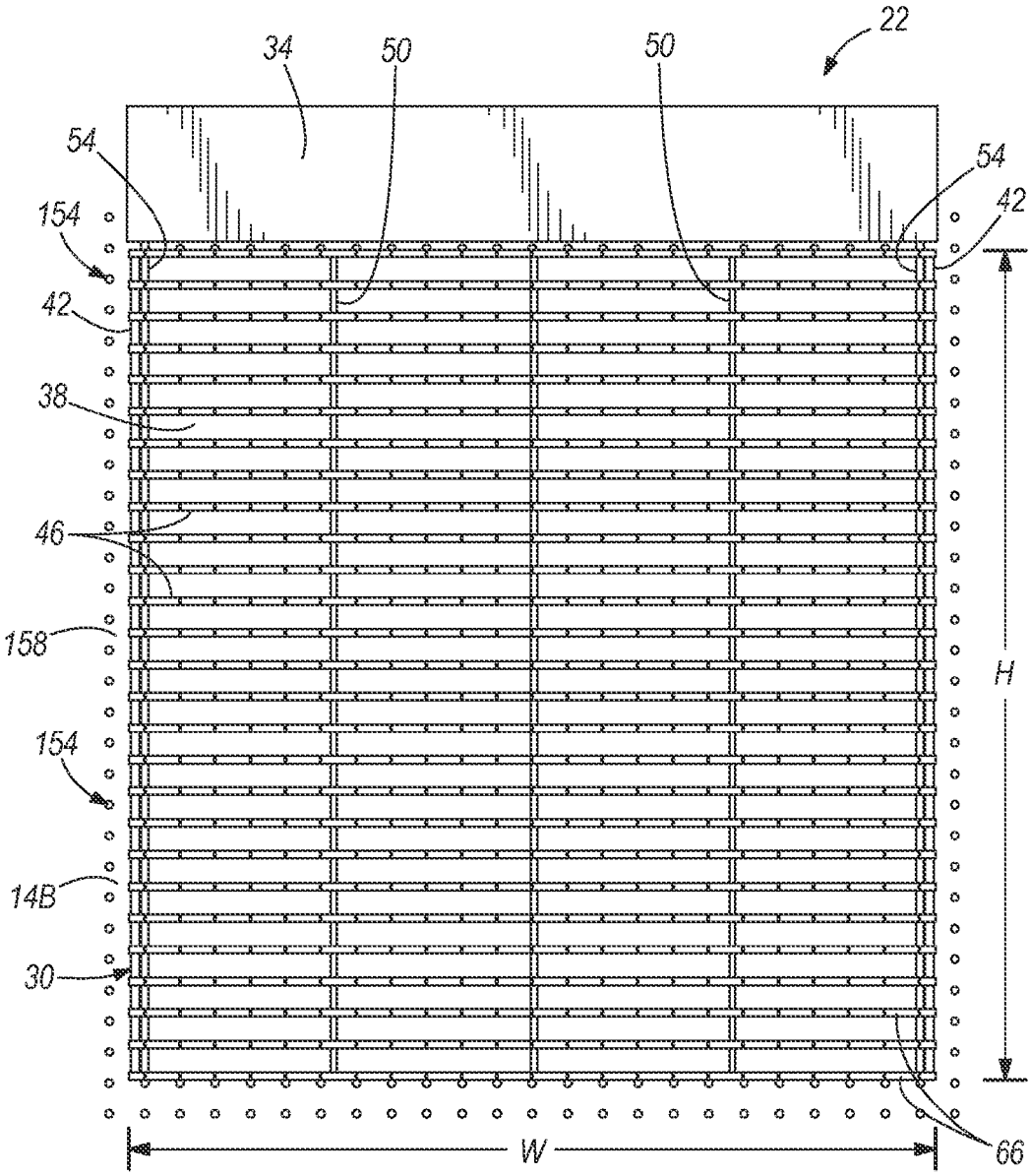
FIG. 2 illustrates a display module of the accessory merchandiser shown in FIG. 1.

FIG. 2 illustrates one of the display modules 22 of the accessory merchandiser 10 shown in FIG. 1. The display module 22 includes a bar structure 30, a display sign or header 34, and a back plate 38. The bar structure 30 is a rigid structure and includes a pair of sides 42, the plurality of horizontal bars 46 extending between the pair of sides 42, vertical bars 50 for supporting the horizontal bars 46 and a pair of fixture hooks 54 (FIG. 3A) for removably coupling the display module 22 to the pegboard 14B. The fixture hooks 54 extend from the sides 42 of the bar structure 30 and couple to the pegboard 14B via respective peg holes. Each side 42 of the bar structure 30 includes a channel 58 (FIGS. 4 and 6), which is generally a U-shaped channel. In other embodiments, the channel may be another shape. The display sign 34 and back plate 38 removably couple to the bar structure 30 via the channels 58 of the pair of sides 42. Although the display sign 34 is illustrated substantially near the top of the display module 22, in other embodiments, the display sign 34 may be oriented at other positions on the display module 22, including but not limited to, substantially near the bottom of the display module 22.

The horizontal and vertical bars 46, 50 are wire-like bars and generally have a circular cross-section. In other constructions, the bars 46, 50 may have a non-circular shape. The plurality of horizontal bars 46 receive the conventional product hooks 26 shown in FIG. 1. To assist in aligning and organizing the product hooks 26, and therein the accessories 18, each horizontal bar 46 includes a plurality of indicator marks 62 (FIG. 3B). The indicator marks 62 form a grid-like structure, or marking grid, on a front surface 66 of the horizontal bars 46. The front surface 66 faces a direction 70 (FIGS. 5B, 7B and 7D) away from the pegboard 14B (i.e., viewable to the consumer or distributor) when the display module 22 of the accessory merchandiser 10 is coupled to the pegboard 14B. Each indicator mark 62 is generally an indentation in the front surface 66 of the horizontal bar 46. In the illustrated embodiment, each indicator mark 62 is oriented vertically. In other constructions, the indicator marks 62 may be vertical slots or channels formed in the horizontal bars 46, such that a user may align the product hooks 26 to the indicator marks 62. In still other embodiments, the indicator marks 62 may be imprinted (e.g., painted, etched, or otherwise marked) onto each horizontal bar 46. In still other embodiments, the horizontal bars 46 of the bar structure 30 may be formed without the indicator marks.

In the illustrated embodiments, the bar structure 30 is manufactured of wire; however, in other embodiments, the bar structure 30 may be formed of steel, metal, plastic, or other suitable material. In the illustrated embodiment, the height "H" and width "W" of the bar structure 30 is approximately 24-inches by approximately 24-inches. However, in further embodiments, the optimal dimensions of the bar structure may be of other various heights and widths that are greater than 24-inches or less than 24-inches.

Figure 3A:
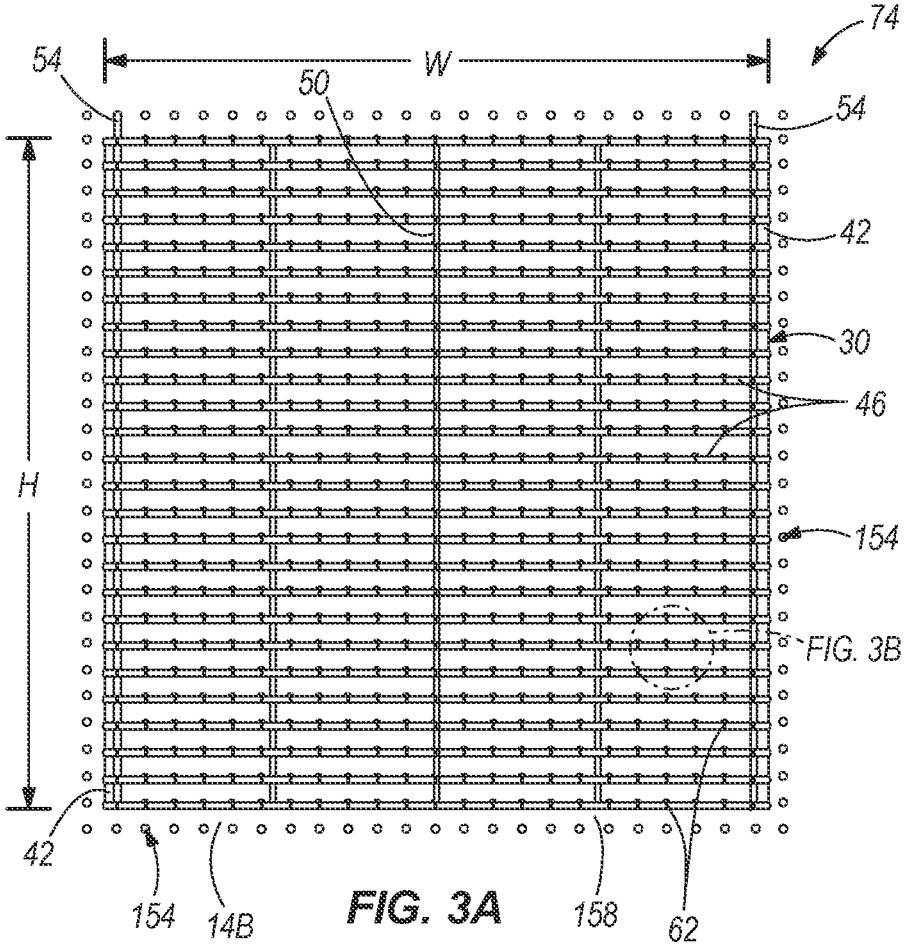
FIG. 3A illustrates a display module for the accessory merchandiser according to another embodiment of the invention.
Figure 3B:
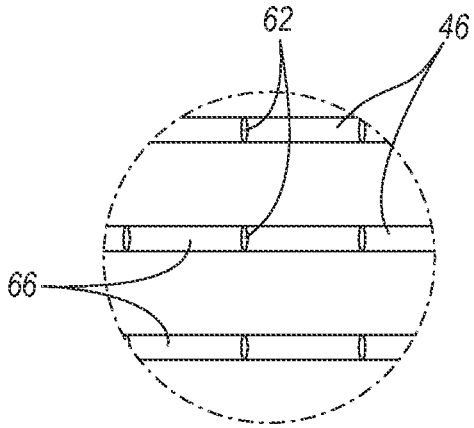
FIG. 3B is an enlarged view of the display module shown in FIG. 3A, and further illustrating indicator marks of the display module.

FIG. 3A illustrates a display module 74 according to another embodiment of the invention. The display module 74 is similar to the display module 22 shown in FIGS. 1 and 2; therefore, like structure will be identified by the same reference numerals. The display module 74 shown in FIG. 3A includes the bar structure 30 that is removably coupled to the pegboard 14B via fixture hooks 54.

FIGS. 4 and 5A-5D illustrate a display module 78 according to another embodiment of the invention. The display module 78 is similar to the display module 74 shown in FIG. 3A; therefore, like structure will be identified by the same reference numerals. The display module 78 shown in FIG. 4 includes the bar structure 30 having three fixture hooks 82 and a rear bar, or stability member 86.

Figure 4:
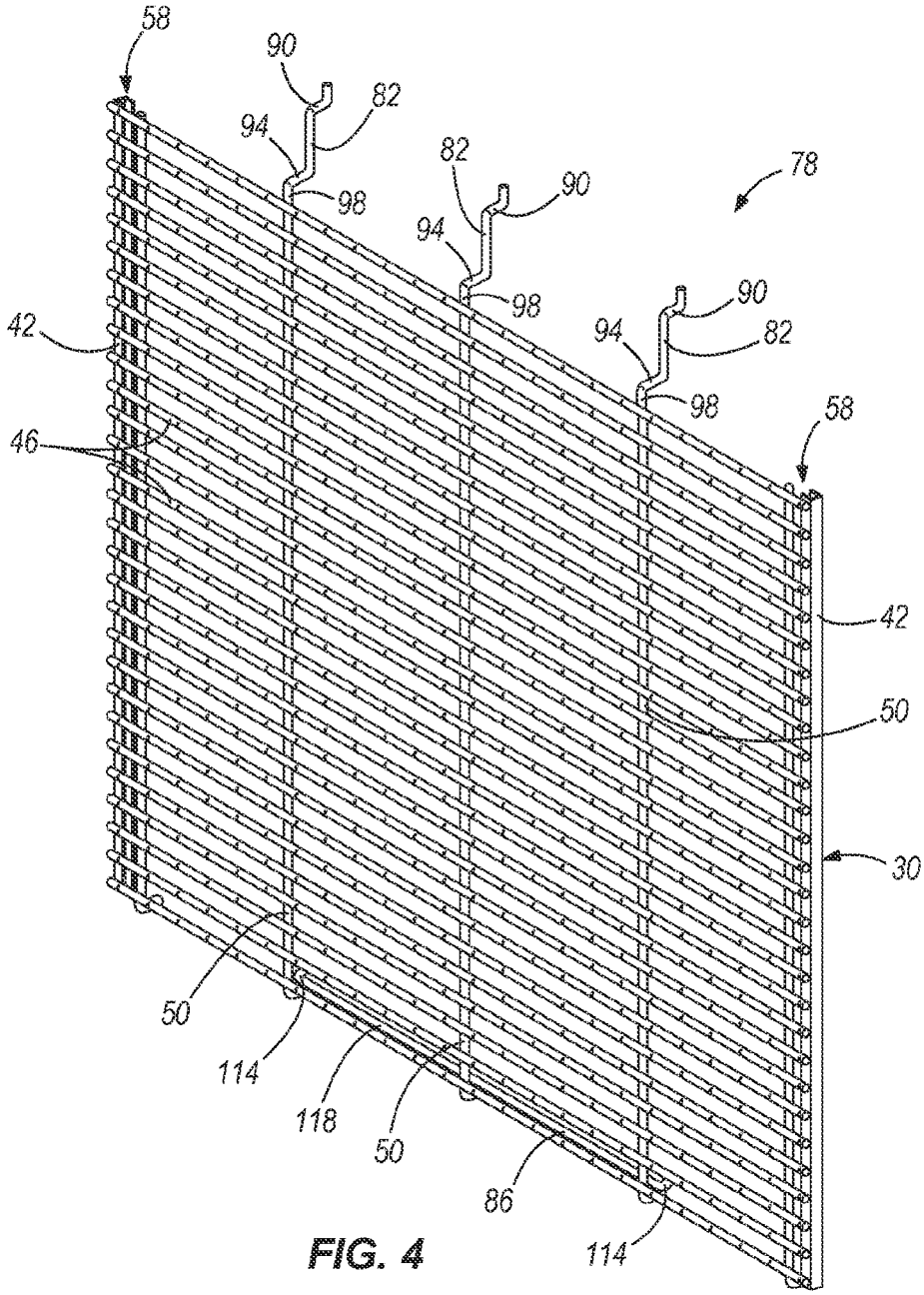
FIG. 4 is a perspective view of a display module of the accessory merchandiser according to another embodiment of the invention.
Figure 5A:
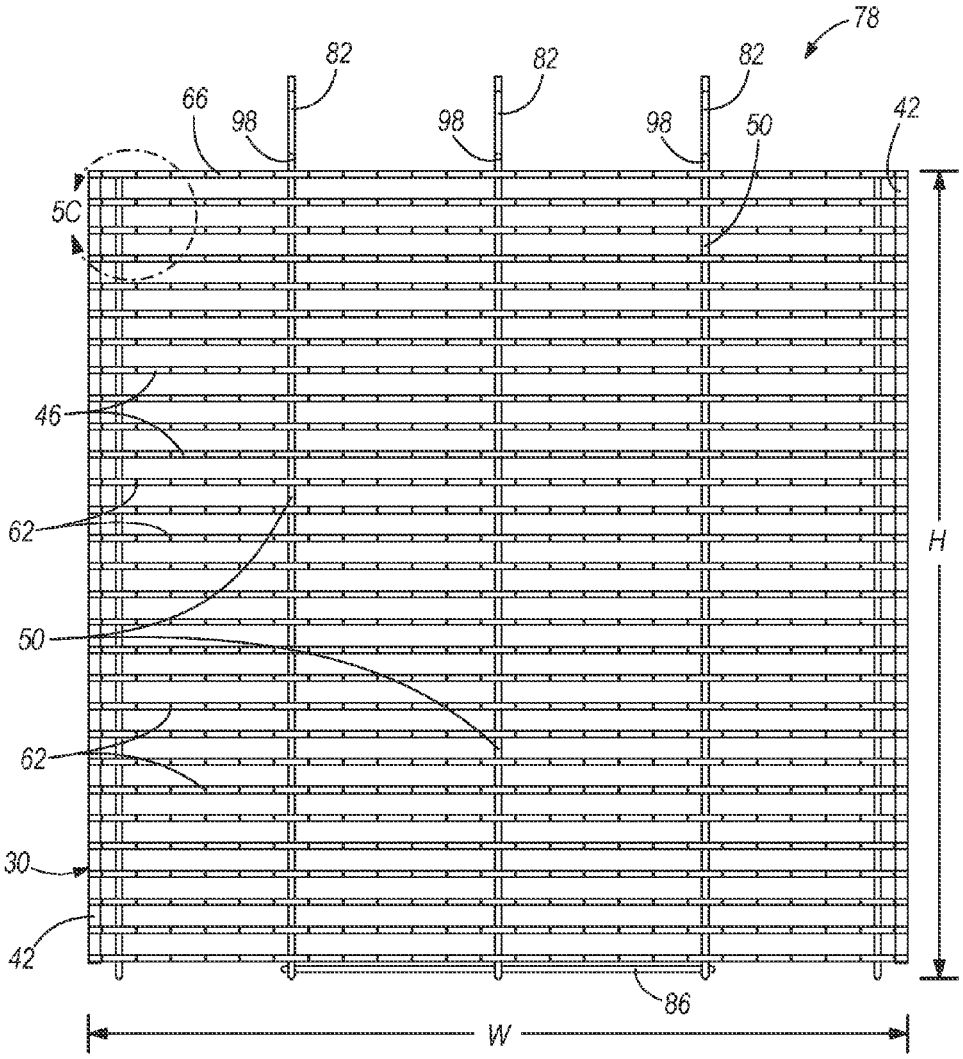
FIG. 5A is a front view of the display module of the accessory merchandiser shown in FIG. 4.
Figure 5C:
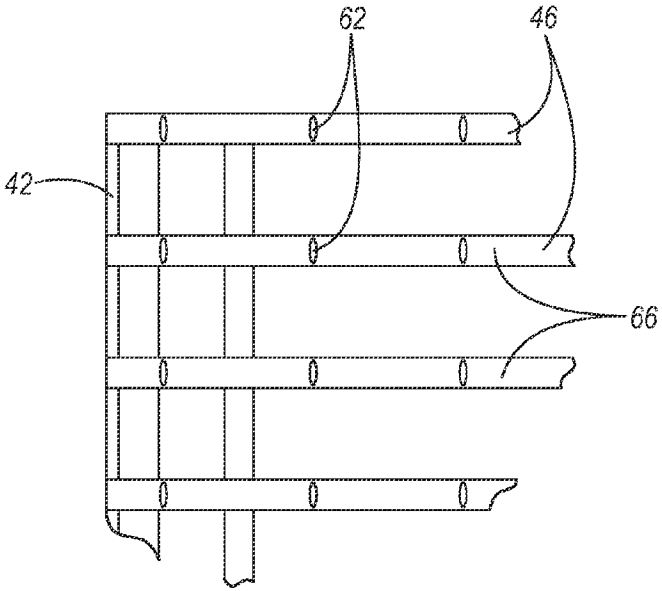
FIG. 5C is an enlarged view of a portion of the display module of FIG. 5A.
Figure 5B:
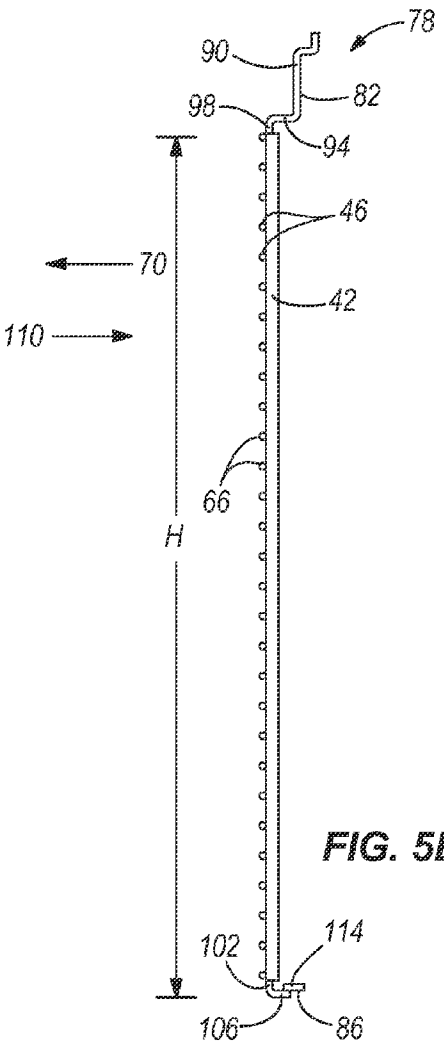
FIG. 5B is a side view of the display module of the accessory merchandiser shown in FIG. 4.

Referring to FIGS. 4 and 5B, each fixture hook 82 includes a first portion 90 and a second portion 94, such that the two portions 90, 94 form a generally S-shaped fixture hook 82. The second portion 94 is coupled to the respective first end 98 (i.e., top ends) of the vertical bars 50. To couple the bar structure 30 to the pegboard 14B, the first portion 90 of each fixture hook 82 is inserted into respective peg holes of the pegboard 14B. When the display module 78 is removably coupled to the pegboard 14B, the first portions 90 of each fixture hook 82 are inserted through the pegboard 14B and the second portions 94 extend outward from the pegboard 14B.

In other constructions, the two portions 90, 94 may form various shapes such that the first portion 90 is integrated or coupled to the pegboard 14B and the second portion 94 couples the first portion 90 to the bar structure 30.

The fixture hooks 82 are positioned such that they are receivable by conventional store fixtures. For example, the horizontal configuration of each fixture hook 82 along the bar structure 30 may be a function of the orientation of the peg holes 154 in the pegboard 14B shown in FIGS. 2 and 3A.

Figure 5D:
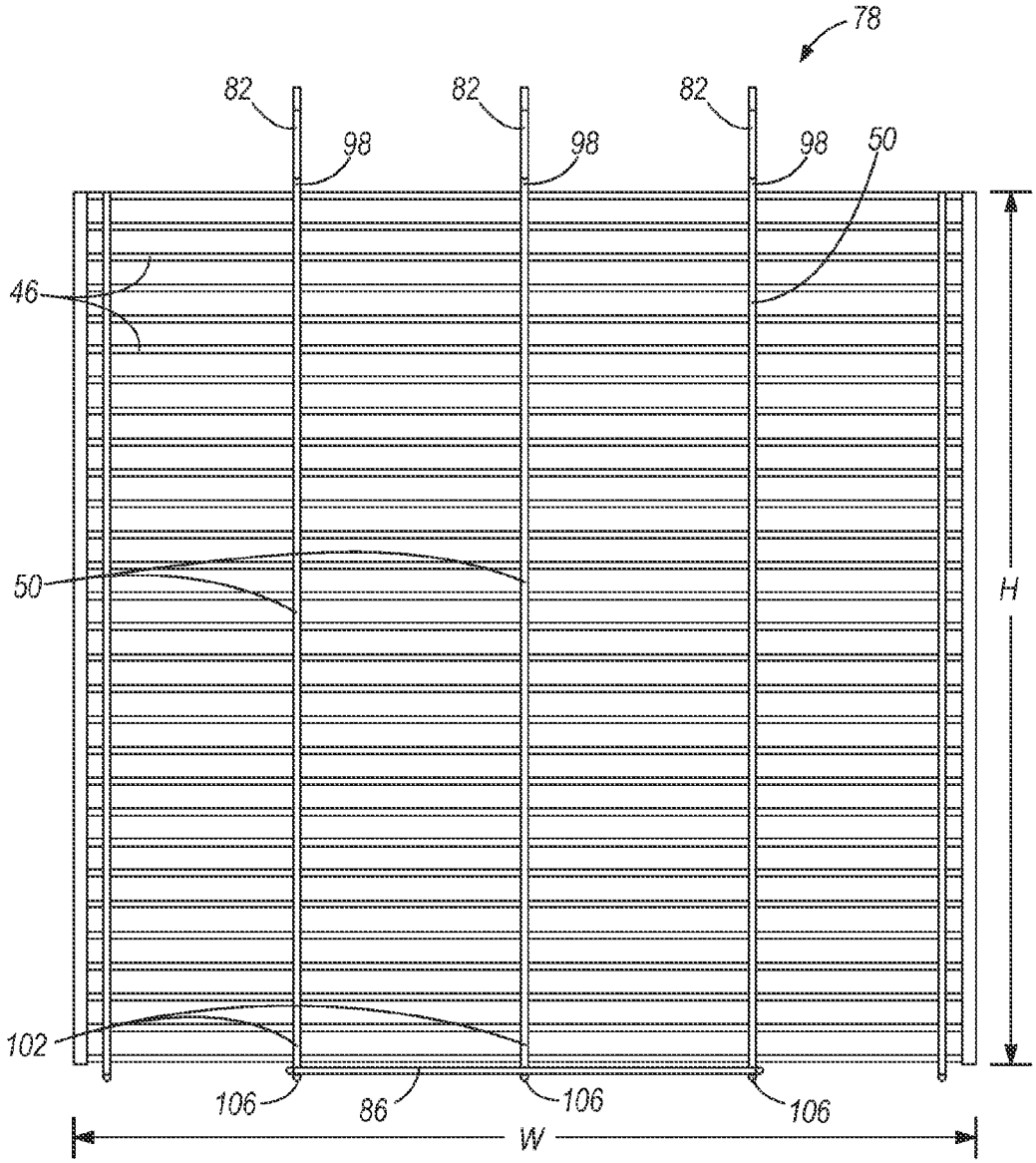
FIG. 5D is a rear view of the display module of the accessory merchandiser shown in FIG. 4.

Referring to FIGS. 5B and 5D, a second end 102 (i.e., bottom end) of each vertical bar 50 is generally L-shaped such that a portion 106 of the second end is substantially perpendicular to the vertical bar 50 and extends in a direction 110 opposite the facing direction 70 of the indicator marks 62. Coupled to the second ends 102 of the vertical bars 50 is the rear bar 86. The stability member, or rear bar 86, as shown in FIG. 4, includes a pair of module hooks 114 and a single horizontal bar 118 extending between the pair of module hooks 114.

FIG. 5C illustrates a portion of the grid-like structure formed by the indicator marks 62 on the horizontal bars 46. Also illustrated is one of the sides 42 that may be used to couple the display sign 34 and/or back plate 38 (FIGS. 1 and 2) to the bar structure 30.

FIGS. 6 and 7A-7D illustrate the display module 78 shown in FIG. 4 including a display sign 122. The display sign 122 includes a front surface 126 and a rear surface 130. As shown, the display sign 122 is formed of a metal material; however, in other constructions, the display sign 122 may be formed of a polymer or plastic material. Sign hooks 134 removably couple the display sign 122 to the bar structure 30. The sign hooks 134 shown are generally L-shaped; however, in other embodiments, the sign hooks 134 may be various shapes, including but not limited to curved or linear.

Figure 7A:
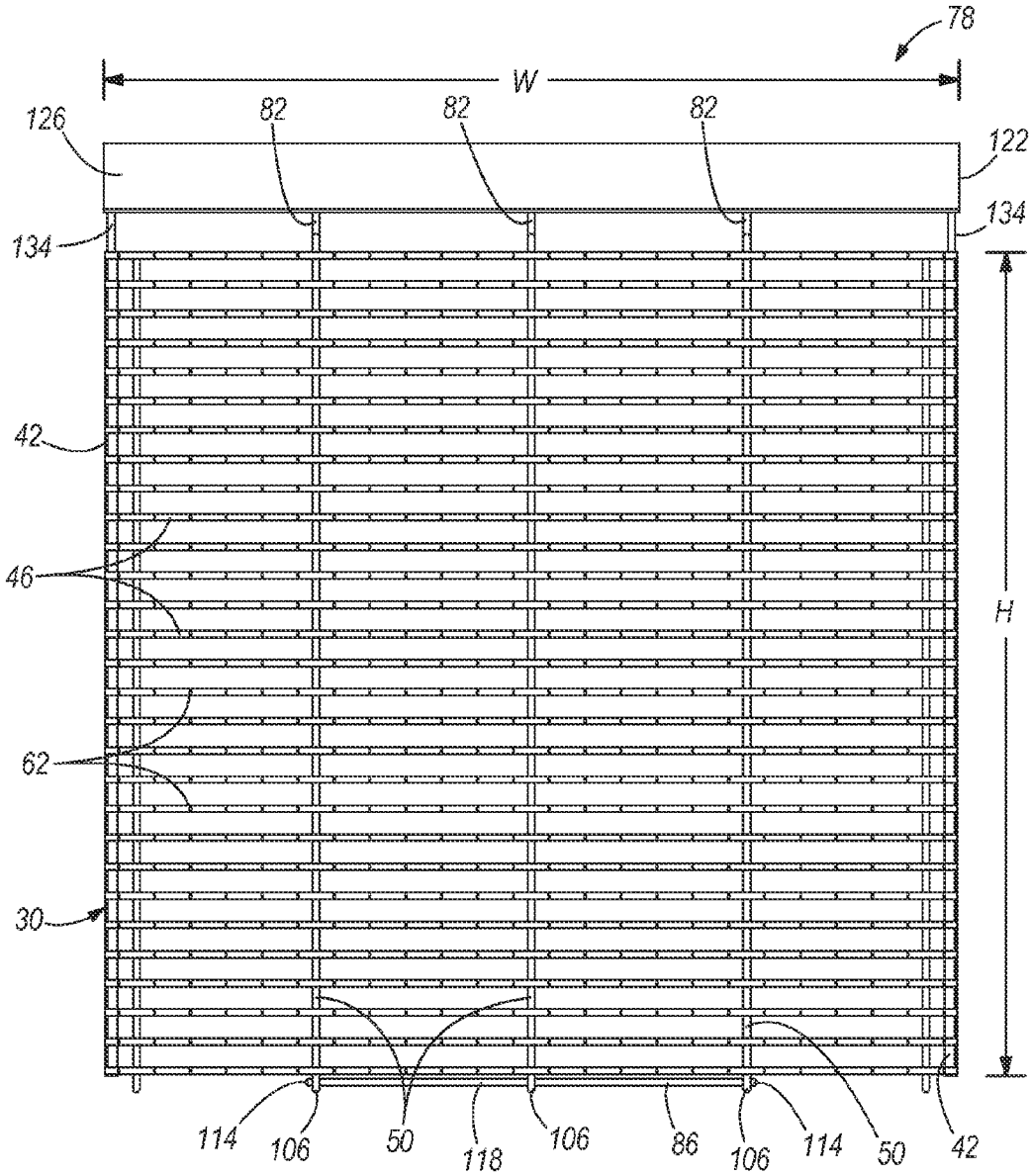
FIG. 7A is a front view of the display module of the accessory merchandiser shown in FIG. 6.
Figure 7C:
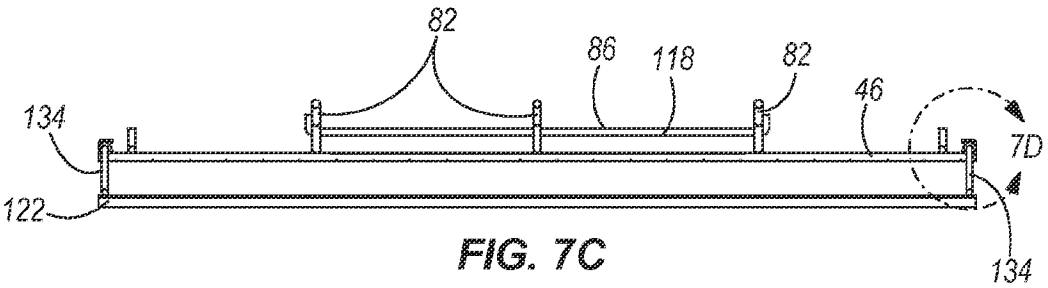
FIG. 7C is a top view of the display module of the accessory merchandiser shown in FIG. 6.
Figure 7D:
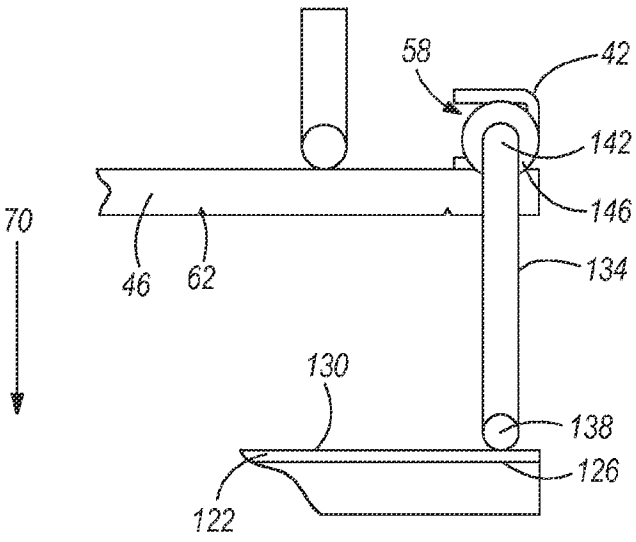
FIG. 7D is an enlarged view of a portion of the display module of FIG. 7C.
Figure 7B:
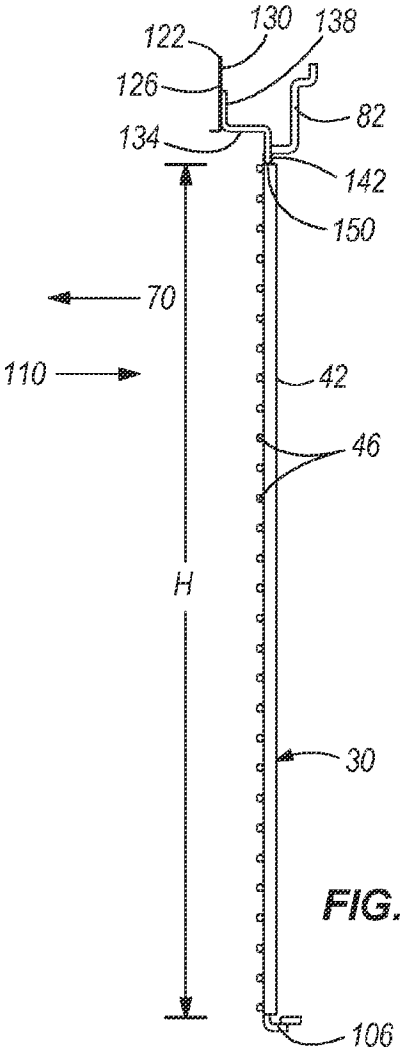
FIG. 7B is a side view of the display module of the accessory merchandiser shown in FIG. 6.

Referring to FIGS. 7B and 7D, each sign hook 134 includes a first end 138 that is coupled to the rear surface 130 of the display sign 122 and a second end 142 that is removably inserted into the respective channels 58 of the pair of sides 42 of the bar structure 30. The second end 142 of each sign hook 134 includes a washer 146. The washers 146 maintain the sign hooks 134, and therein the display sign 122, at a desired elevation by abutting a top 150 of the sides of the bar structure 30. The front surface 126 of the display sign 122 provides the distributor an easy way to inform the customer about the accessories 18 on display. For example, the display sign 122 may show the product brand and/or type of product(s) 18 supported by product hooks 26 (FIG. 1). In other embodiments, the display sign 122 may show other information. In still other embodiments, the display sign 122 may be oriented at a location other than substantially near the top of the display module 78, including but limited to, substantially near the bottom of the display module 78.

Figure 6:
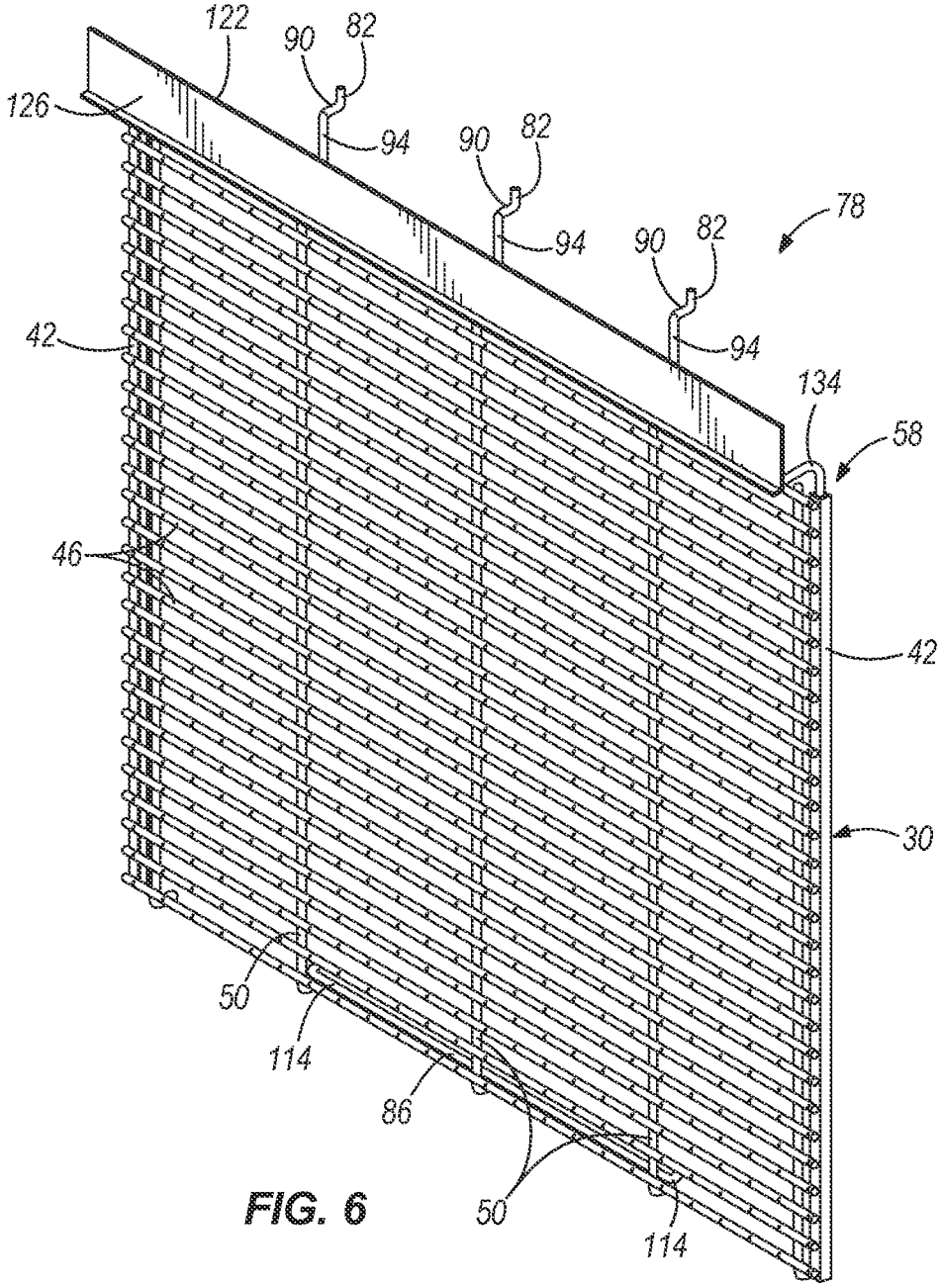
FIG. 6 is a perspective view of the display module of the accessory merchandiser shown in FIG. 4 including a display sign.

In the illustrated embodiment, the display module 78 has a weight of approximately 7-lbs. When the display sign 122 is coupled to the display module 78, as shown in FIG. 6, the weight of the display module 78 increases to approximately 7.8-lbs. In other constructions, the display module may weigh more than 7-lbs or less than 7-lbs.

Each display module 78 is able to interlock with the pegboard 14B and vertically neighboring display modules 78 without the use of tools. In addition, each display module 78 has a large weight capacity for the accessories to be supported. In some embodiments, the bar, and therein the display module 78 may be coated with a polymer (e.g., painted or powder coated).

To install the accessory merchandiser 10 having a single display module (e.g., the display module 78 shown in FIG. 4), the fixture hooks 82 of the display modules 78 are coupled to the store fixture (e.g., slot wall 14A, pegboard 14B, etc.) by inserting the fixture hooks 82 into aperture(s) 154 (FIG. 2) (e.g., slots, peg holes, perforations, channels, etc.) of the store fixture. When the fixture hooks 82 have been inserted into the store fixture, the display module 78 will then be supported by the store fixture. Accordingly, the fixture hooks 82 support the weight of the display module 78 and may support the weight of the accessories 18. With the display module 78 suspended from the fixture hooks 82, the back bar 86 then abuts a front surface 158 of the store fixture (FIGS. 1, 2 and 3A) such that the display module 78 is suspended parallel to the front surface 158 of the store fixture.

As discussed above, multiple display modules 22, 78 may be used for the accessory merchandiser 10. Each display module 22, 78 is easily removed from the store fixture and, if desired, movable to alternate locations on the store fixture or even alternate store fixtures. When more than one display module (e.g., either or both of display modules 22 and 78) is desired for the accessory merchandiser, a similar installation procedure to that of the single display module 78 is followed for the additional display modules 22, 78. When the additional display modules 22, 78 are installed above one another, the back bar 86 of the display module 22, 78 being installed will abut the fixture hooks 82 of the previously installed display module (display module 78 in the example) positioned below to properly space adjacent modules 22, 78.

In other embodiments, the multiple display modules 22, 78 may be installed in the store fixture (e.g., pegboard 14B) by coupling another display module 22, 78 below the previously installed display module (display module 78 in the example above) such that the back bar 86 of the previously installed display module 78 will abut fixture hooks 82 of the display module 22, 78 presently being installed.

In other embodiments, a shelf, which may be a plurality of shelves, may be removably coupled to the accessory merchandiser 10. The dimensions of the shelf may range from approximately 8-inches to approximately 48-inches.

Although the invention has been described in detail with reference to certain preferred embodiments, variations and modifications exist within the scope and spirit of one or more independent aspects of the invention as described. Various features and advantages of the invention are set forth in the following claims.

What is claimed is:

1. An accessory merchandiser for displaying products, the accessory merchandiser comprising:

a modular unit including a plurality of discrete first members and a plurality of discrete second members, wherein the first and second members form a grid structure that defines a plurality of elongated slots between adjacent second members;

a plurality of indicator marks formed on each second member; and a plurality of coupling members configured to removably couple the modular unit to a fixture;

wherein the plurality of indicator marks form a marking grid for aligning the products being displayed.

2. The accessory merchandiser of claim 1, further comprising a plurality of product supports configured to releasably couple the products to the modular unit.

3. The accessory merchandiser of claim 2, wherein the indicator marks are configured to aid in positioning the product supports on the modular unit.

4. The accessory merchandiser of claim 1, further comprising a removable display sign configured to display information.

5. The accessory merchandiser of claim 1, further comprising a stability member extending in a direction away from the modular unit toward the fixture.

6. The accessory merchandiser of claim 1, wherein the indicator marks are indentations formed on a front surface of the second members.

7. The accessory merchandiser of claim 1, wherein the indicator marks are configured to aid a user in positioning products on the accessory merchandiser.

8. An accessory merchandiser for displaying products, the accessory merchandiser comprising:

a grid structure formed by a plurality of discrete vertical members and a plurality of discrete horizontal members;

a first side and a second side, each of the first side and the second side extending parallel to the plurality of discrete vertical members and having a channel, wherein the plurality of discrete horizontal members extend between and couple to the first and second sides;

a fixture support configured to releasably couple the grid structure to a fixture; and a plurality of indicator marks formed on each of the plurality of discrete horizontal members for aligning the products being displayed.

9. The accessory merchandiser of claim 8, further comprising a plurality of product supports for releasably coupling the products to the grid structure.

10. The accessory merchandiser of claim 9, wherein the indicator marks are configured to aid in positioning the product supports on the grid structure.

11. The accessory merchandiser of claim 8, further comprising a display sign releasably coupled to the channels of the first and second sides.

12. The accessory merchandiser of claim 11, further comprising a support member for vertically adjusting the display sign.

13. The accessory merchandiser of claim 8, further comprising a stability member extending in a direction away from the grid structure toward the fixture.

14. The accessory merchandiser of claim 8, wherein the indicator marks are indentations formed on a front surface of the plurality of discrete horizontal members.

15. The accessory merchandiser of claim 8, wherein the indicator marks are configured to aid a user in positioning products on the accessory merchandiser.

16. An accessory merchandiser for displaying products, the accessory merchandiser comprising:

a plurality of modular units, each of the plurality of modular units including a plurality of discrete first members and a plurality of discrete second members, such that each modular unit forms a grid structure defining a plurality of elongated slots between adjacent second members; and a plurality of indicator marks formed on each second member of the plurality of modular units, such that the plurality of indicator marks form a marking grid for aligning the products being displayed;

wherein each of the plurality of modular units includes a coupling member configured to removably couple the modular unit to a fixture; and wherein each of the plurality of modular units is removably couplable to an adjacent modular unit.

17. The accessory merchandiser of claim 16, wherein the indicator marks are indentations formed on a front surface of the second members.

18. The accessory merchandiser of claim 16, wherein the indicator marks aid a user in positioning products on the accessory merchandiser.

19. The accessory merchandiser of claim 16, wherein the indicator marks aid in positioning a plurality of product supports on the plurality of modular units.

20. The accessory merchandiser of claim 16, further comprising a removable display sign configured to display information.

* * * * *